US007356269B2

(12) United States Patent
Park

(10) Patent No.: US 7,356,269 B2
(45) Date of Patent: Apr. 8, 2008

(54) APPARATUS AND METHOD FOR SENSING WASTE TONER IN AN ELECTROPHOTOGRAPHIC IMAGE FORMING APPARATUS

(75) Inventor: Jong-hwa Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 252 days.

(21) Appl. No.: 10/746,145

(22) Filed: Dec. 29, 2003

(65) Prior Publication Data

US 2004/0190918 A1 Sep. 30, 2004

(30) Foreign Application Priority Data

Dec. 30, 2002 (KR) ..... 10-2002-0087151

(51) Int. Cl.
*G03G 21/12* (2006.01)

(52) U.S. Cl. ..... 399/35

(58) Field of Classification Search ..... 399/13, 399/35, 81, 123, 358, 360, 120; 118/694; 340/612, 617

See application file for complete search history.

(56) References Cited

U.S. PATENT DOCUMENTS 4,501,484 A * 2/1985 Shimura ..... 399/164
5,101,228 A * 3/1992 Nishikawa et al. ..... 399/35
5,260,755 A * 11/1993 Imaizumi ..... 399/35
5,530,521 A * 6/1996 Lee ..... 399/29
5,589,915 A * 12/1996 Hashimoto ..... 399/120
6,122,459 A * 9/2000 Ogasawara ..... 399/27

FOREIGN PATENT DOCUMENTS

JP 63-70578 5/1988
JP 02262181 A * 10/1990
JP 07306582 A * 11/1995
JP 09325670 A * 12/1997
JP 2000122484 A * 4/2000

* cited by examiner

*Primary Examiner*—Robert Beatty
(74) *Attorney, Agent, or Firm*—Roylance, Abrams, Berdo & Goodman L.L.P.

(57) ABSTRACT

An electrophotographic forming apparatus includes a light-emitting portion, a light-receiving portion, a waste toner sensing unit which is pivotably installed in a main body where the waste toner container is attachably and detachably mounted between the light-emitting portion and the light-receiving portion, intercepts light irradiated from the light-emitting portion when the waste, toner, container is not mounted in the main body, and does not intercept light when the waste toner container is mounted in the main body, such that a voltage output from the light-receiving portion is compared with a preset voltage and whether the waste toner container is mounted, the replacement time of the waste toner container can be sensed.

21 Claims, 4 Drawing Sheets

APPARATUS AND METHOD FOR SENSING WASTE TONER IN AN ELECTROPHOTOGRAPHIC IMAGE FORMING APPARATUS

This application claims the priority of Korean Patent Application No. 2002-87151, filed on Dec. 30, 2002, in the Korean Intellectual Property Office, the disclosure of which is incorporated herein in its entirety by reference.

BACKGROUND OF THE INVENTION

1. Field of the Invention

The present invention relates to an electrophotographic image forming apparatus, and more particularly, to an electrophotographic image forming apparatus having a waste toner sensing unit which senses whether a waste toner container is mounted, the amount of waste toner, and contamination of the waste toner container.

2. Description of the Related Art

In general, an electrophotographic image forming apparatus is a device which forms an electrostatic latent image on a photosensitive medium by exposing the photosensitive medium charged by a charger using light irradiated from a laser scanning unit (LSU) in response to a print signal, develops the electrostatic latent image with a developing agent supplied by a developing unit, forms an image, and transfers the image onto paper, thereby obtaining a desired image.

The developing agent, which is used to develop the electrostatic latent image and to form the image in the electrophotographic image forming apparatus, is composed of toner in a powder state and a liquid carrier.

The toner is attached to the electrostatic latent image and is used to form the electrostatic latent image as an image. In this case, all of the toner attached to the electrostatic latent image is not transferred from the photosensitive medium to a transfer unit or from the transfer unit to paper, and a part of the toner remains on the photosensitive medium or the transfer unit.

The toner remaining on the photosensitive medium or the transfer unit is removed by an additional cleaning unit and stored in a waste toner container by a removing unit.

Meanwhile, the liquid carrier is removed by an additional carrier removing unit. In particular, a color developing unit uses a developing agent of four colors, such as yellow, cyan, magenta, and black, and thus, the amount of waste toner increases compared to a developing unit using a single color. Thus, a time for replacing the waste toner container needs to be checked by sensing the amount of waste toner stored in the waste toner container, and whether the waste toner container is mounted needs to be sensed.

An apparatus for sensing the amount of waste toner stored in a waste toner container is disclosed in U.S. Pat. No. 4,099,861 and Japanese Patent Publication No. JP 07-271116, the entire contents of which are incorporated herein by reference.

FIG. 1 illustrates a structure of a conventional waste toner sensing apparatus. Waste toner 120 removed by a waste toner removing unit (not shown) is stored in a waste toner container 100 through an intake 110. The waste toner sensing apparatus includes a light-emitting portion 150 for radiating light and a light-receiving portion 160 for receiving light irradiated from the light-emitting portion 150. The light-emitting portion 150 and the light-receiving portion 160 are installed opposite to each other wherein the waste toner container 100 is placed therebetween and below.

A switch 170 is separately installed under the waste toner container 100. The switch 170 is turned on or off when the waste toner container 100 is mounted in or detached from a main body, intercepts light irradiated from the light-emitting portion 150, and indicates whether the waste toner container 100 is mounted.

If light irradiated from the light-receiving portion 150 hits the waste toner 120 stored in the waste toner container 100, the light is not received by the light-receiving portion 160. Thus, when there is a difference between the amount of light that does not hit the waste toner 120 and is normally received by the light-receiving portion 160, and the amount of light received by the light-receiving portion 160 that has not hit the waste toner 120, the waste toner 120 is sensed. In this case, as the amount of light received by the light-receiving portion 160 becomes smaller, the greater the amount of waste toner stored in the waste toner container 120.

However, the waste toner 120 may be attached to an inner side 101 of the waste toner container 100. The waste toner 130 attached to the inner side 101 of the waste toner container 100 serves to intercept light irradiated from the light-receiving portion 150 so that the light is not received by the light-receiving portion 160. Accordingly, since the waste toner 130 is attached to the inner side 101 of the waste toner container 100, the waste toner 120 may erroneously be sensed to have completely filled the waste toner container 100.

SUMMARY OF THE INVENTION

The present invention provides an electrophotographic image forming apparatus having a waste toner sensing unit which can sense the contamination of a waste toner container and the amount of waste toner stored in the waste toner container, and a method of sensing waste toner using the same.

According to an aspect of the present invention, an electrophotographic image forming apparatus is provided that has a waste toner sensing unit in which waste toner occurring during a series of processes of forming an image is stored. The waste toner sensing unit includes a light-emitting portion installed opposite to a light-receiving portion. The waste toner container is preferably placed between the light-emitting portion and the light-receiving portion. The light-emitting portion radiates light on the waste toner container and a light-receiving portion installed opposite to the light-emitting portion. The light-receiving portion receives light irradiated from the light-emitting portion that passes through the waste toner container, and outputs a voltage corresponding to the amount of received light. An actuator which is installed in a main body where the waste toner container is mounted between the light-emitting portion and the light-receiving portion preferably intercepts light irradiated from the light-emitting portion when the waste toner container is not mounted in the main body, and does not intercept light when the waste toner container is mounted in the main body. The apparatus also preferably has a controlling portion which controls the waste toner sensing unit to compare voltage output from the light-receiving portion with a preset voltage and to display a message in accordance with a comparison result. There is also preferably a message displaying portion which displays a message to a user in response to a control signal transmitted from the controlling portion.

According to another aspect of the present invention, a method of sensing waste toner includes radiating light from a light-emitting portion on a waste toner container; receiving light irradiated from the light-emitting portion and passing through the waste toner container; comparing an output voltage, which corresponds to the amount of light received by the light-receiving portion, with a preset voltage and determining the size of the output voltage; and displaying a message, which corresponds to a comparison and determination result of the output voltage and the preset voltage, in a message displaying portion.

According to another aspect of the present invention, a method of sensing waste toner includes radiating light from a light-emitting portion onto a waste toner container, and receiving light irradiated from the light-emitting portion that passes through the waste toner container. If an output voltage which corresponds to the amount of light received by the light-receiving portion is within a first voltage range, the method includes outputting a message indicating that "waste toner container is not present." If the output voltage which corresponds to the amount of light received by the light-receiving portion is within a second voltage range, the method includes outputting a message indicating that "waste toner container needs to be replaced." If the output voltage which corresponds to the amount of light received by the light-receiving portion is within a third voltage range, the method includes outputting a message indicating that "waste toner container is contaminated." If the output voltage corresponds to the amount of light received by the light-receiving portion is within a fourth voltage range, the method includes outputting a message indicating that "normal state where waste toner container is not contaminated."

BRIEF DESCRIPTION OF THE DRAWINGS

The above and other aspects and advantages of the present invention will become more apparent by describing in detail a preferred embodiment thereof with reference to the attached drawing figures, in which.

It will be understood that in the drawing figures like reference numerals are intended to illustrate like features and structures.

DETAILED DESCRIPTION OF THE PREFERRED EMBODIMENT

Figure 1:
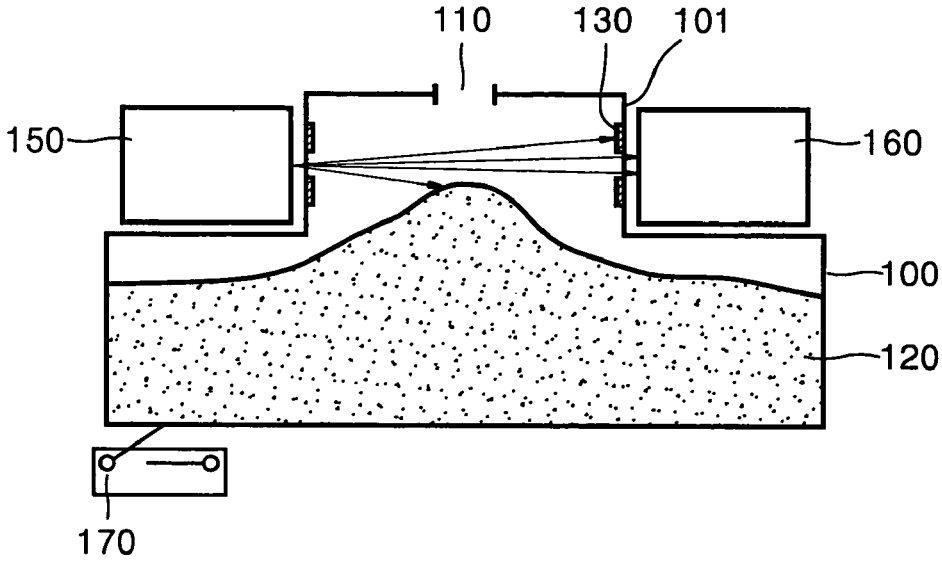
FIG. 1 (PRIOR ART)
FIG. 1 illustrates a structure of a conventional waste toner sensing apparatus.
Figure 2:
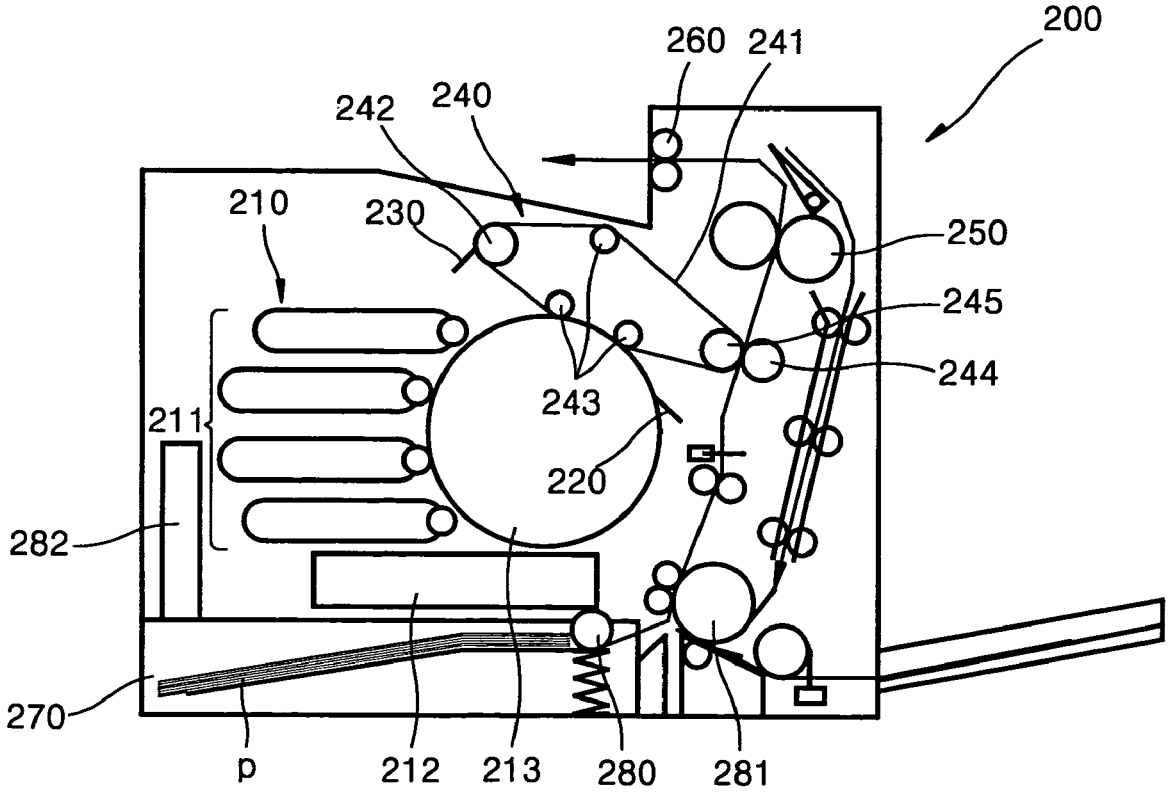
FIG. 2 schematically illustrates a structure of an electrophotographic image forming apparatus using a waste toner sensing unit according to an embodiment of the present invention.
Figure 3:
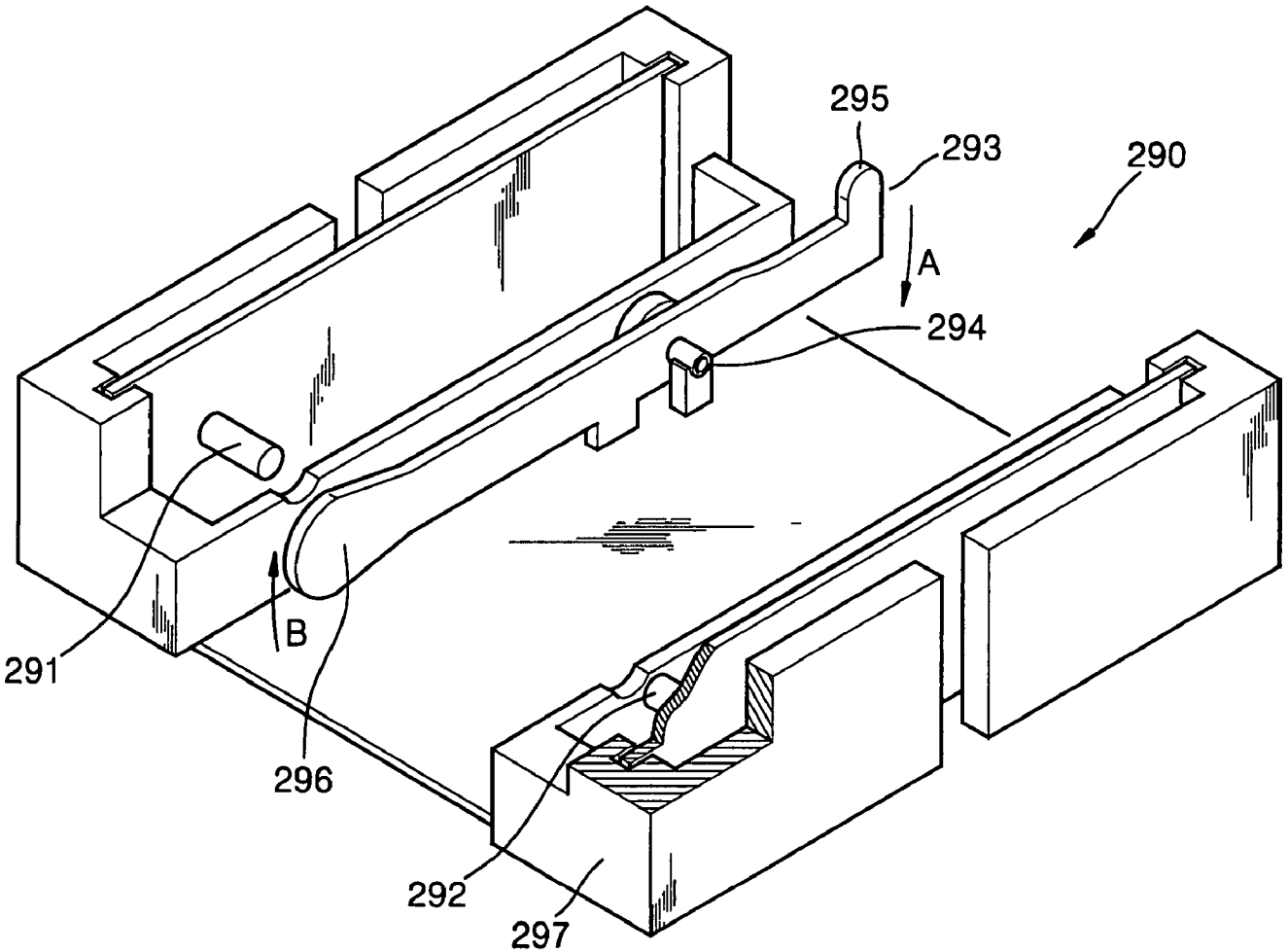
FIG. 3 is a perspective view illustrating a structure of the waste toner sensing unit according to an embodiment of the present invention.
Figure 4:
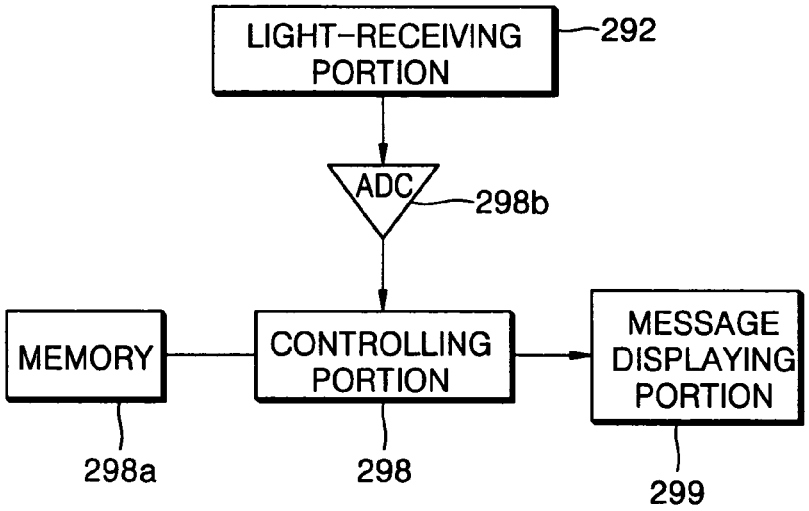
FIG. 4 illustrates a block structure of the waste toner sensing unit according to an embodiment of the present invention.

FIG. 2 schematically illustrates a structure of an electrophotographic image forming apparatus using a waste toner sensing unit according to an embodiment of the present invention. FIG. 3 is a perspective view illustrating a structure of a waste toner sensing unit according to an embodiment of the present invention. FIG. 4 illustrates a block structure of the waste toner sensing unit according to an embodiment of the present invention.

Referring to FIG. 2, an electrophotographic image forming apparatus 200 includes a developing unit 210, a transfer unit 240, a fusing unit 250, a paper exhaust unit 260, a pickup unit 280, and a waste toner sensing unit 290.

The developing unit 210 superposes a developing agent supplied from a cartridge 211 in which a developing agent of four colors, such as yellow, cyan, magenta, and black, is stored, on an electrostatic latent image formed on the surface of a photosensitive medium 213 by a laser scanning unit 212 in response to a print signal, thereby forming an image.

The transfer unit 240 includes a transfer belt 241 and a transfer roller 244. The transfer belt 241 is supported by a plurality of support rollers 243, a steering roller 242, and a transfer backup roller 245. The belt is rotated in a closed trace shape, contacts the surface of the photosensitive medium 213, and accordingly, the image formed on the surface of the photosensitive medium 213 is transferred onto the transfer belt 241. The transfer roller 244 is installed opposite to the transfer backup roller 245 wherein the transfer belt 241 is placed therebetween, and transfers the image formed on the surface of the transfer belt 241 onto a printing medium P.

The fusing unit 250 fuses the image onto the paper P by applying heat and pressure to the image transferred onto the paper P. The paper exhaust unit 260 exhausts the printing medium P on which the image is fused, towards an outside of the main body.

The pickup unit 280 picks up a sheet of the printing medium P stacked on a cassette 270 that can be attached or detached to or from the main body.

Reference numeral 220 denotes a photosensitive cleaning blade which is installed to contact the photosensitive medium 213 and removes developing agent remaining on the photosensitive medium 213 after the image is transferred from the photosensitive medium 213 onto the transfer belt 241. Reference numeral 230 denotes a transfer belt cleaning blade which is installed opposite to the steering roller 242 wherein the transfer belt 241 is placed therebetween and removes a developing agent remaining on the surface of the transfer belt 241.

Toner removed by the photosensitive medium cleaning blade 220 and the transfer belt cleaning blade 230 is stored in a waste toner container 282 placed above the cassette 270, by using a removing unit (not shown).

The waste toner sensing unit 290 includes a light-emitting portion 291, a light-receiving portion 292, and an actuator 293, as shown in FIG. 3.

The light-emitting portion 291 is fixed in a support 297 provided in the main body and radiates light. The light-receiving portion 292 is fixed in the support 297 provided in the main body and receives light from the light-emitting portion 291.

The actuator 293 is placed between the light-emitting portion 291 and the light-receiving portion 292, is pivotably installed centering on a pivot shaft 294 provided in the main body, and selectively intercepts light irradiated from the light-emitting portion 291 and received by the light-receiving portion 292.

The actuator 293 preferably includes a protrusion part 295 and an interception part 296. The protrusion part 295 is pressed while contacting the waste toner container 282 when the waste toner container (282 of FIG. 2) is mounted in the main body, and moves downward in the direction shown by arrow A. The interception part 296 is provided at a side opposite to the protrusion part 295 and intercepts light irradiated from the light-emitting portion 291 while moving upward in the direction shown by arrow B, when the protrusion part 295 moves in the direction of arrow A.

Thus, the interception part 296 of the actuator 293 intercepts light irradiated from the light-emitting portion 291 when the waste toner container 282 is not mounted in the main body. When the waste toner container 282 is mounted in the main body, the protrusion part 295 moves in the direction of arrow A while being pressed by the waste toner container 282, and the interception part 296 moves in the direction of arrow B, and light irradiated from the light-emitting portion 291 is received by the light-receiving portion 292.

Thus, the actuator 293 selectively intercepts light irradiated from the light-emitting portion 291 depending on whether the waste toner container 282 is mounted in the main body. Referring to FIG. 4, the waste toner sensing unit 290 includes a controlling portion 298 and a message displaying portion 299. The controlling portion 298 controls the waste toner sensing unit 290 to compare a voltage corresponding to the amount of light received by the light-receiving portion 292 with a preset voltage and to display a message to a user in accordance with a comparison result. The message displaying portion 299 displays a message in response to a signal output from the controlling portion 298. Preferably, an analog-to-digital converter (ADC) 298*b* which converts an analog signal output from the light-receiving portion 292 to a digital signal, is installed between the light-receiving portion 292 and the controlling portion 298. Reference numeral 298*a* denotes a memory, which can comprise, for example, a read only memory (ROM) which is connected to the controlling portion 298 and in which a program for controlling a message output to the message displaying portion 299 is stored, and a random access memory (RAM) in which information to be printed or a voltage output from the light-receiving portion 292 is temporarily stored.

Figure 5:
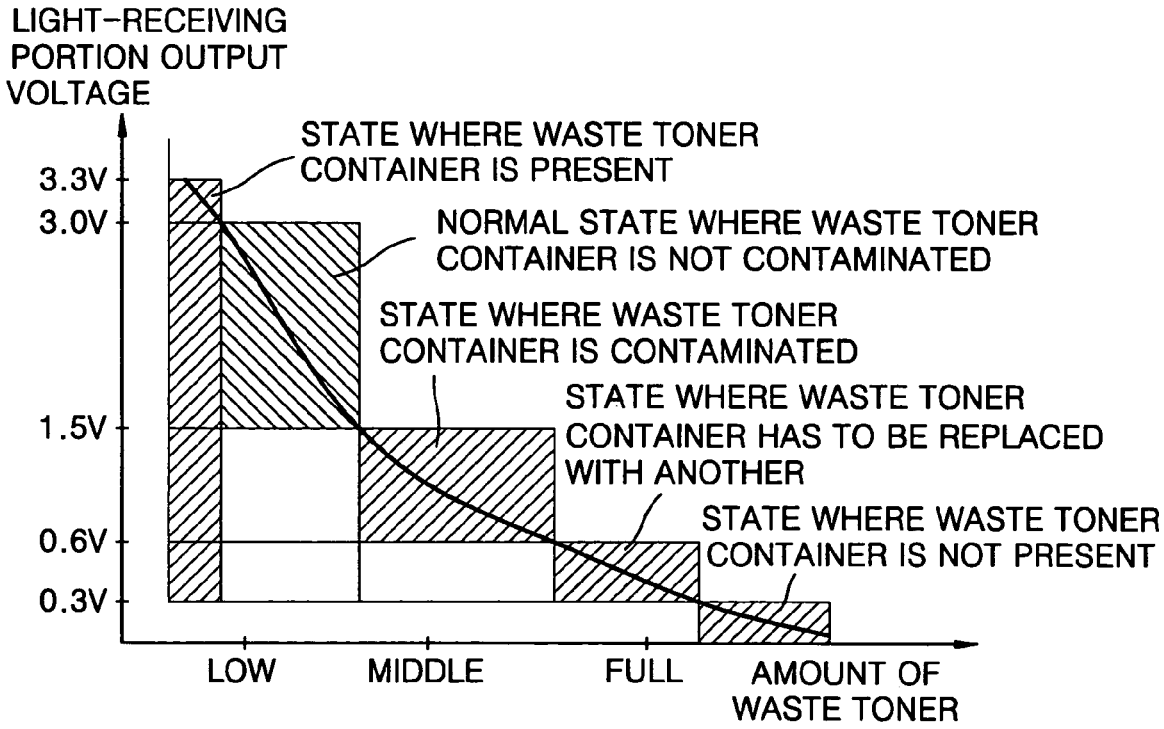
FIG. 5 is a graph showing a light-receiving portion output voltage versus the amount of waste toner in the waste toner sensing unit according to an embodiment of the present invention.

FIG. 5 is a graph showing a light-receiving portion output voltage versus the amount of waste toner in the waste toner sensing unit according to an embodiment of the present invention. It should be understood that the voltages and ranges described herein are intended to be exemplary in nature, and should not be considered exact values. As will be appreciated by those of ordinary skill in the art, any suitable electrical signal ranges and values could be selected to make the various determinations described herein, while remaining within the scope of the invention.

If a light-receiving portion output voltage is greater than a preset level, such as 0.3V, the waste toner container 282 is mounted in the main body. The voltage output by the light-receiving portion decreases as more light irradiated from the light-emitting portion 291 hits the waste toner stored in the waste toner container 282 and is substantially prevented from being received by the light-receiving portion 292.

If the light-receiving portion output voltage is less than 0.3V, the waste toner container 282 is not mounted in the main body. Thus, the interception part 296 intercepts light irradiated from the light-emitting portion 291, and light is substantially prevented from being received by the light-receiving portion 292.

If the light-receiving portion output voltage is greater than 0.3V and less than 0.6V, removed toner is completely filled (FULL) in the waste toner container 282, and thus, the waste toner container 282 has to be replaced with another.

If the light-receiving portion output voltage is greater than 0.6V and less than 1.5V, the waste toner is not completely filled in the waste toner container 282 (FULL). Hereinafter, a medium amount of the waste toner is filled in the waste toner container 282 (MIDDLE). However, a sidewall of the waste toner container 282 is contaminated with the waste toner, and thus, the waste toner may erroneously be sensed as being completely filled in the waste toner container 282 (FULL). That is, some of the light irradiated from the light-emitting portion 291 is intercepted by the waste toner remaining on the sidewall of the waste toner container 282 and is not received by the light-receiving portion 292, and thus, a voltage output from the light-receiving portion 292 decreases.

If the light-receiving portion output voltage is greater than 1.5V, and less than 3V, a small amount of the waste toner is stored in the waste toner container 282 (LOW), and the sidewall of the waste toner container 282 is not contaminated with the waste toner.

If the voltage output by the light-receiving portion is greater than 3V, the waste toner container 282 is mounted in the main body, and the waste toner is not stored in the waste toner container 282.

Figure 6:
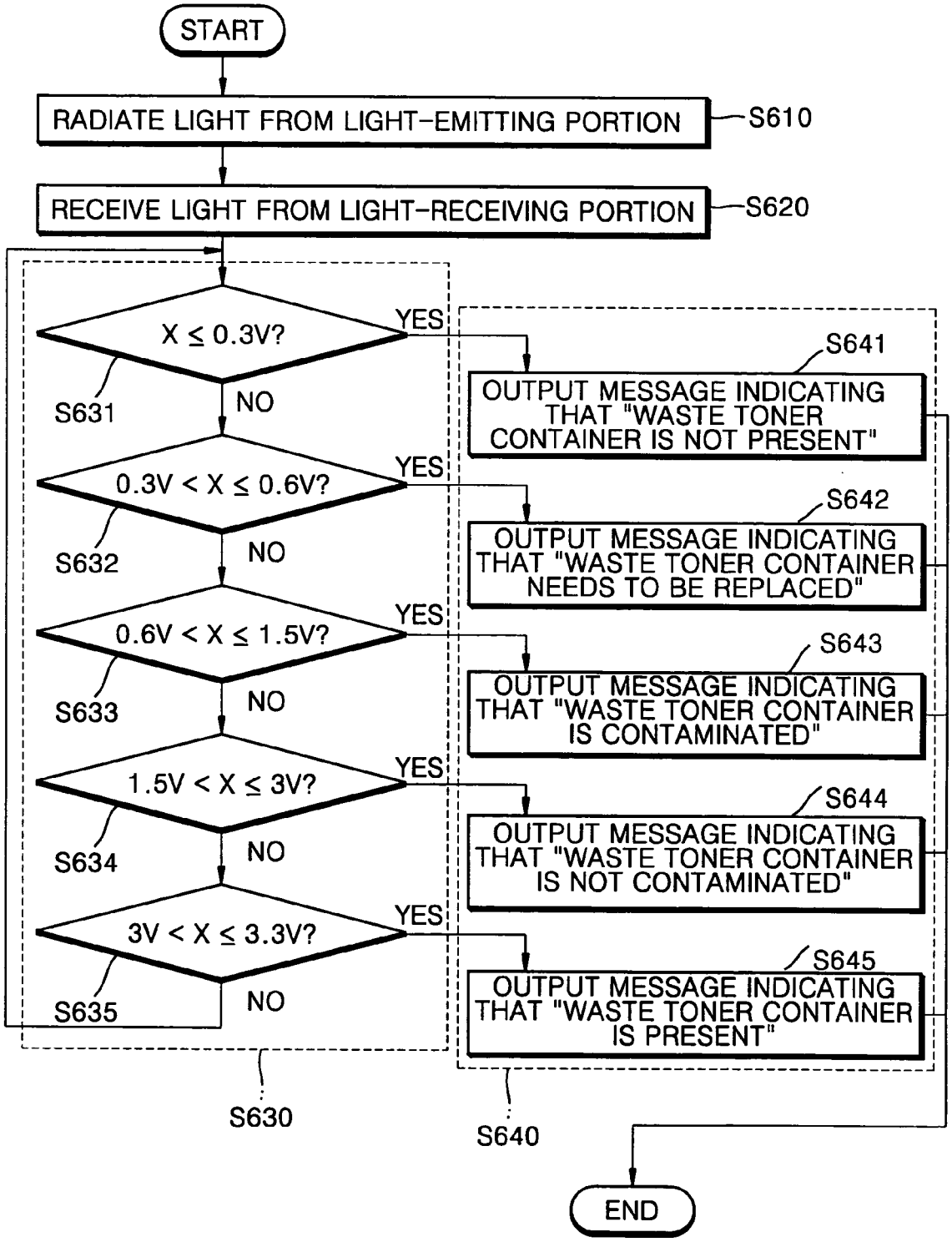
FIG. 6 is a flowchart illustrating a method of sensing waste toner according to an embodiment of the present invention.

FIG. 6 is a flowchart illustrating a method of sensing waste toner according to the present invention.

The method of sensing waste toner according to the present invention comprises steps of radiating light from the light-emitting portion 291 (S610), receiving light irradiated from the light-emitting portion 291 at the light-receiving portion 292 (S620), comparing an output voltage X corresponding to the amount of light received by the light-receiving portion 292 with a preset voltage and determining the size of the output voltage X (S630), and displaying a message corresponding to a comparison result of the output voltage and the preset voltage in the determination step S630 (S640).

The determination step S630 comprises steps of determining whether the output voltage X is less than 0.3V (S631), determining whether the output voltage X is greater than 0.3V and less than 0.6V (S632), determining whether the output voltage X is greater than 0.6V and less than 1.5V, (S633), determining whether the output voltage X is greater than 1.5V, and less than 3V (S634), and determining whether the output voltage X is greater than 3V and less than 3.3V (S635).

The displaying step S640 comprises steps of outputting a message indicating that "waste toner container is not present" if the output voltage X is less than 0.3V in step S631 (S641), outputting a message indicating that "waste toner container needs to be replaced" if the output voltage X is greater than 0.3V and less than 0.6V in step S632 (S642), outputting a message indicating that "waste toner container is contaminated" if the output voltage X is greater than 0.6V and less than 1.5V, in step S633 (S643), outputting a message indicating that "normal state where waste toner container is not contaminated" if the output voltage X is greater than 1.5V, and less than 3V in step S634 (S644), and outputting a message indicating that "waste toner container is present" if the output voltage X is greater than 3V and less than 3.3V in step S635 (S645).

The above-described method of sensing waste toner will be described in detail below.

In step S610, light is irradiated from the light-emitting portion 291 to the light-receiving portion 292. In step S620, the light-receiving portion 292 receives light irradiated from the light-emitting portion 291 and outputs an output voltage X corresponding to the amount of received light. The controlling portion (298 of FIG. 4) controls the waste toner sensing unit 290 to compare the voltage X output from the light-receiving portion 292 with a preset voltage stored in the memory 298*a* and to determine the size of the voltage X. Preferably, the preset voltage is between 0.3V and 3.3V.

In step S631, if it is determined that the output voltage X is less than 0.3V, in step S641, the message indicating that "waste toner container is not present" is output to the message displaying portion (299 of FIG. 4), and the above steps are terminated. If not, in step S632, whether the output voltage X is greater than 0.3V and less than 0.6V is determined. If so, in step S642, the message indicating that "waste toner container needs to be replaced" is output to the message displaying portion 299, and the above steps are terminated.

In step S633, if the output voltage X is greater than 0.6V and less than 1.5V, in step S643, the message indicating that "waste toner container is contaminated" is output to the message displaying portion 299, and the above steps are terminated.

If not, whether the output voltage X is greater than 1.5V, and less than 3V, if it is determined that the output voltage X is greater than 1.5V, and less than 3V, in step S644, the message indicating that "normal state where waste toner container is not contaminated" is output to the message displaying portion 299, and the above steps are terminated.

If the output voltage X is greater than 3V and less than 3.3V, in step S645, the message indicating that "waste toner container is present" is output to the message displaying portion 299, and the above steps are terminated. If not, the method returns to step S630, the measured voltage is compared with the preset voltage, and the size of the measured voltage is determined.

As described above, in the waste toner sensing unit according to an embodiment of the present invention, because of a voltage difference using one waste toner sensing unit, whether a waste toner container is mounted, the replacement time of the waste toner container, and the contamination of the waste toner container can be recognized, so manufacturing costs can be reduced, and malfunction can be prevented.

While this invention has been particularly shown and described with reference to a preferred embodiment thereof, it will be understood by those skilled in the art that various changes in form and details may be made therein without departing from the spirit and scope of the invention as defined by the appended claims and equivalents thereof.

What is claimed is:

1. An electrophotographic image forming apparatus having a waste toner sensing unit in which waste toner occurring during a series of processes of forming an image is stored, wherein the waste toner sensing unit comprises:

a light-emitting portion installed opposite to a light-receiving portion, and adapted to radiate light on the waste toner container, the waste toner container being placed between the light emitting portion and the light receiving portion, and the light receiving portion receiving light irradiated from the light-emitting portion that passes through the waste toner container and outputting a voltage corresponding to the amount of received light;

an actuator installed in a main body where the waste toner container is mounted between the light-emitting portion and the light-receiving portion, the actuator intercepting light irradiated from the light-emitting portion when the waste toner container is not mounted in the main body, and not intercepting light when the waste toner container is mounted in the main body;

a controlling portion which controls the waste toner sensing unit to compare a voltage output from the light-receiving portion with a preset voltage and to determine, based on the voltage output, whether the waste toner container is mounted in the main body, and an amount of toner in the waste toner container when the waste toner container is mounted in the main body, and to display a message in accordance with a comparison result; and a message displaying portion which displays a message to a user in response to a control signal transmitted from the controlling portion.

2. The apparatus of claim 1, further comprising a contact part adapted to contact the waste toner container when the waste toner container is mounted in the main body, and to cause an interception part of said actuator to selectively intercept light irradiated from the light-emitting portion.

3. The apparatus of claim 2, wherein the contact part is a protrusion part which contacts the bottom side of the waste toner container.

4. The apparatus of claim 2, wherein the actuator is pivotably installed.

5. A method of sensing waste toner, the method comprising:

radiating light from a light-emitting portion on a waste toner container;

receiving light irradiated from the light-emitting portion and passing through the waste toner container;

comparing an output voltage, which corresponds to the amount of light received by the light-receiving portion, with at least one preset voltage and determining that a waste toner container is not mounted when the amount of light received is below a predetermined threshold, and that the waste toner container is mounted when the amount of light received is above the predetermined threshold; and displaying a message, which corresponds to a comparison and determination result of the output voltage and the at least one preset voltage, in a message displaying portion.

6. The method of claim 5, wherein the at least one preset voltage comprises at least one range between a first voltage level and a second voltage level.

7. The method of claim 6, wherein the at least one range is between 0.3V and 3.3V.

8. The method of claim 6, wherein in comparing the output voltage with the at least one preset voltage, the output voltage corresponds to at least one range between voltage levels.

9. The method of claim 6, wherein in comparing the output voltage with the at least one preset voltage, if the output voltage is within a predetermined range between a first voltage level and a second voltage level, outputting a message indicating that "waste toner container is not present".

10. The method of claim 9, wherein the first voltage level is about 0V and the second voltage level is about 0.3V.

11. The method of claim 6, wherein the step of displaying of the message comprises, if the output voltage is within a predetermined range between a first voltage level and a second voltage level, outputting a message indicating that "waste toner container needs to be replaced".

12. The method of claim 11, wherein the first voltage level is about 0.3V and the second voltage level is about 0.6V.

13. The method of claim 6, wherein the step of displaying of the message comprises, if the output voltage is within a predetermined range between a first voltage level and a second voltage level, outputting a message indicating that "waste toner container is contaminated".

14. The method of claim 13, wherein the first voltage level is about 0.6V and the second voltage level is about 1.5V.

15. The method of claim 6, wherein the step of displaying of the message comprises, if the output voltage is greater than a first voltage level, outputting a message indicating that "normal state where waste toner container is not contaminated".

16. The method of claim 15, wherein the first voltage level indicates that the output voltage is greater than about 1.5V.

17. A method of sensing waste toner, the method comprising:

radiating light from a light emitting portion onto a waste toner container;

receiving light irradiated from the light-emitting portion and that passes through the waste toner container;

when an output voltage which corresponds to a minimum amount of light received by the light-receiving portion is within a range of a first voltage level, outputting a message indicating that "waste toner container is not present";

when the output voltage which corresponds to the amount of light received by the light-receiving portion is within a range of a second voltage level, outputting a message indicating that "waste toner container needs to be replaced";

when the output voltage which corresponds to the amount of light received by the light-receiving portion is within a range of a third voltage level, outputting a message indicating that "waste toner container is contaminated"; and when the output voltage which corresponds to a maximum amount of light received by the light-receiving portion is within a range of a fourth voltage level, outputting a message indicating that "normal state where waste toner container is not contaminated".

18. The method of claim 17, wherein the range of the first voltage level is less than 0.3V.

19. The method of claim 17, wherein the range of the second voltage level is greater than 0.3V and less than 0.6V.

20. The method of claim 17, wherein the range of the third voltage level is greater than 0.6V and less than 1.5V.

21. The method of claim 17, wherein the range of the fourth voltage level is greater than 1.5V.

* * * * *